US006839917B1

(12) United States Patent
Landwehr

(10) Patent No.: US 6,839,917 B1
(45) Date of Patent: Jan. 11, 2005

(54) WORK CLOTHING WITH SNAP-ON POCKETS

(76) Inventor: Paul H. Landwehr, 904 Westlyn Ct., Farmington, MN (US) 55024

( * ) Notice: Subject to any disclaimer, the term of this patent is extended or adjusted under 35 U.S.C. 154(b) by 0 days.

(21) Appl. No.: 10/729,498

(22) Filed: Dec. 5, 2003

(51) Int. Cl.[7] ..... A41D 13/00
(52) U.S. Cl. ..... 2/455; 2/22; 2/242
(58) Field of Search ..... 2/455, 22–24, 2/46, 48, 51, 52, 69, 227, 242, 267, 247

(56) References Cited

U.S. PATENT DOCUMENTS

| | | | | | |
|---|---|---|---|---|---|
| 889,470 | A | * | 6/1908 | Lyons | 2/51 |
| 1,451,095 | A | * | 4/1923 | Greene | 2/51 |
| 3,095,576 | A | * | 7/1963 | Jenter | 2/51 |
| 3,517,394 | A | * | 6/1970 | Robinson | 2/51 |
| 4,651,355 | A | | 3/1987 | White | 2/247 |
| 4,984,303 | A | | 1/1991 | Ross | 2/227 |
| 5,038,408 | A | | 8/1991 | DeBaene | 2/23 |
| 5,054,127 | A | * | 10/1991 | Zevchak | 2/247 |
| 5,134,726 | A | * | 8/1992 | Ross | 2/465 |
| 5,517,696 | A | * | 5/1996 | Krugler | 2/250 |
| D373,892 | S | | 9/1996 | Landwehr | D2/747 |
| 5,566,391 | A | * | 10/1996 | Williamson | 2/51 |
| 5,774,892 | A | | 7/1998 | Tisdale et al. | 2/69 |
| 5,920,902 | A | | 7/1999 | Crampton | 2/24 |
| 6,202,215 | B1 | * | 3/2001 | Sauter | 2/51 |
| 6,338,164 | B1 | * | 1/2002 | Howard | 2/242 |
| 6,473,905 | B1 | * | 11/2002 | Katz | 2/48 |
| 6,654,962 | B2 | * | 12/2003 | DeMott | 2/22 |

* cited by examiner

*Primary Examiner*—Gloria M. Hale
(74) *Attorney, Agent, or Firm*—Nikolai & Mersereau, P.A.

(57) ABSTRACT

A work garment for use by gardeners, roofers or others to protect their clothing while working and for holding articles in pockets, which may be changed by snapping on special pockets for different uses of the garment. The pockets can be of different sizes and be segmented or not for holding different articles. The garment may have permanent and snap-on pockets. The garment is fastened around the waist of the wearer by a belt and the legs fastened by straps around the wearer's legs. Kneepads in kneepad pockets protect the wearer's knees and make working more comfortable while kneeling. The garment extends from the waist to just below the knees for a lightweight easy to put on and easy to take off garment.

8 Claims, 2 Drawing Sheets

WORK CLOTHING WITH SNAP-ON POCKETS

BACKGROUND OF THE INVENTION

1. Field of the Invention

This invention relates to work clothing and more particularly to apron-like pants, or chaps, with interchangeable snap-on pockets and removable knee padding.

2. Description of the Related Art

Work clothing in the past has included pants with kneepads for working on various projects such as roofing, or other construction jobs, gardening, sports or other activities where extra protection is needed. These articles of clothing have usually been pants, which totally surround the wearer rather than an apron-like front to cover and protect the pants of the worker. Other apron-like cloths in the form of chaps have a seat portion, which surrounds the user like pants on a portion of the garment. They can have kneepads and pockets, however they are not as easy to get into and out of and are full-length garments covering all of the pants of the wearer.

Some garments have had snap-on pockets to add or replace pockets when needed.

SUMMARY OF THE INVENTION

No garment found provides a pair of apron-like shorts covering from the waist to just below the knee having kneepads and snap-on pockets such that only the front of the wearers pants are protected. The wearer can use the apron-like garment with shorts or regular length pants. There are optional pockets for different uses. For example a pocket for holding seeds or garden tools can be used by a gardener. A carpenter would use different pockets for holding nails or carpenter tools. The pockets can be changed for performing other tasks making the garment a multipurpose garment. Fixed pockets are optionally used which may have dividers in the pockets for tools or other articles. Further the garment has kneepads, which can be installed in pockets on the garment. The kneepads are useful if the wearer will be doing gardening, roofing or other tasks where the wearer will be on his knees.

Objects of the Invention

It is an object of the invention to protect the knees of the wearer during work activity.

It is an object of the invention to protect the clothing of the wearer from excessive exposure to dirt and wear.

It is an object of the invention to optionally provide snap-on pockets to utilize specialized pockets for different activities.

It is an object of the invention to provide a cool working garment, which can protectively cover the clothing of the wearer.

It is an object of the invention to provide a garment, which is easy to put on and take off.

It is an object of the invention to provide a lightweight working garment, which can protectively cover the clothing of the wearer.

It is an object of the invention to provide a garment, which can be used with shorts.

Other objects, advantages and novel features of the present invention will become apparent from the following detailed description of the invention when considered in conjunction with the accompanying drawing.

DESCRIPTION OF THE PREFERRED EMBODIMENTS

Figure 1:
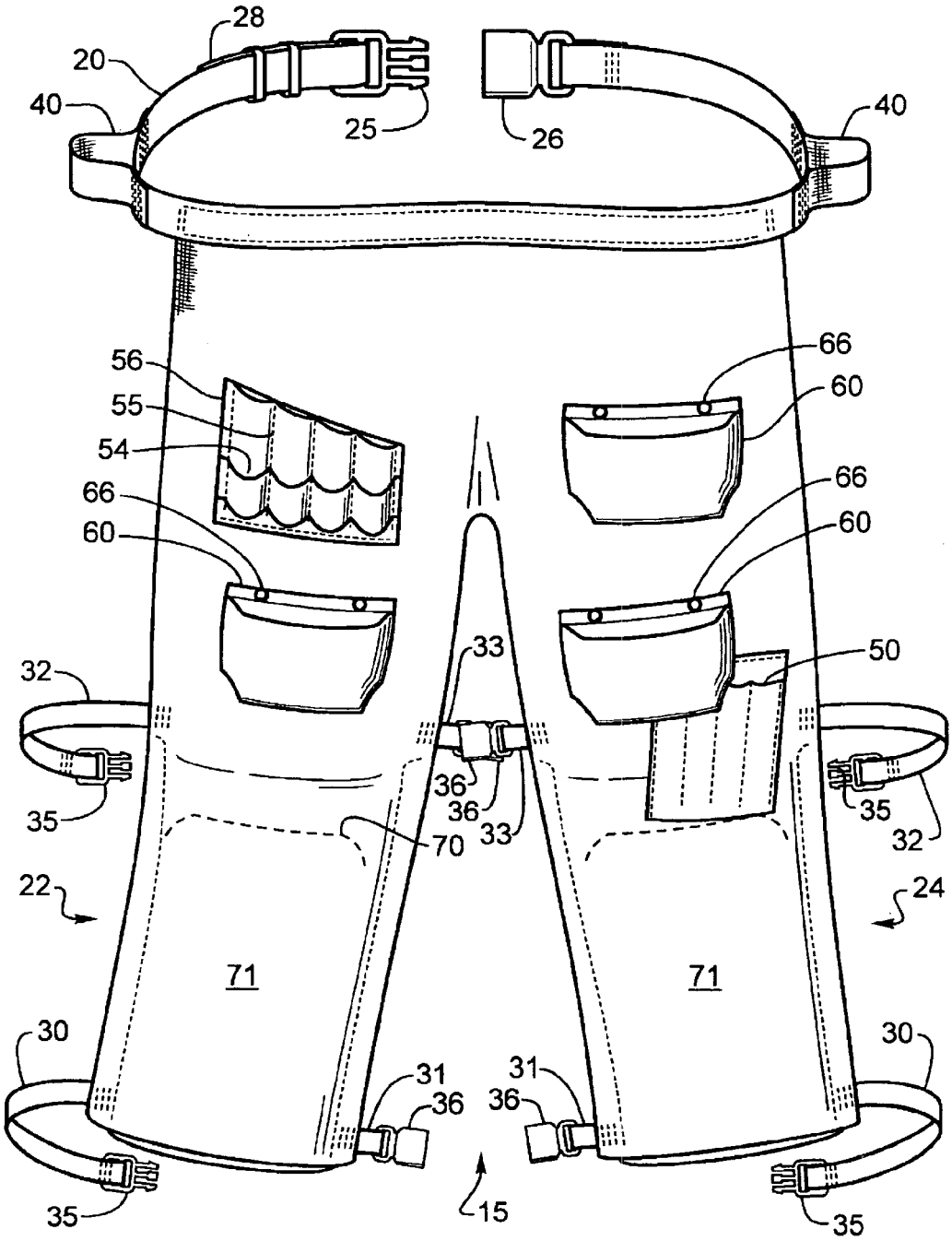
FIG. 1 is a front view of the work clothing.

FIG. 1 shows the front of the work clothing 15. The work clothing 15 is apron-like. It has a belt portion 20, which is attached to the top of work clothing 15 and surrounds the waist of the wearer attaching the waist portion of the work clothing 15 to the wearer's waist. The belt portion 20 may have a belt buckle, VELCRO® hook and loop fastener strips, or as shown, have male 25 and female 26 connecting portions and a belt length adjustment ring 28 for adjusting the belt to the waist size of the wearer.

Figure 2:
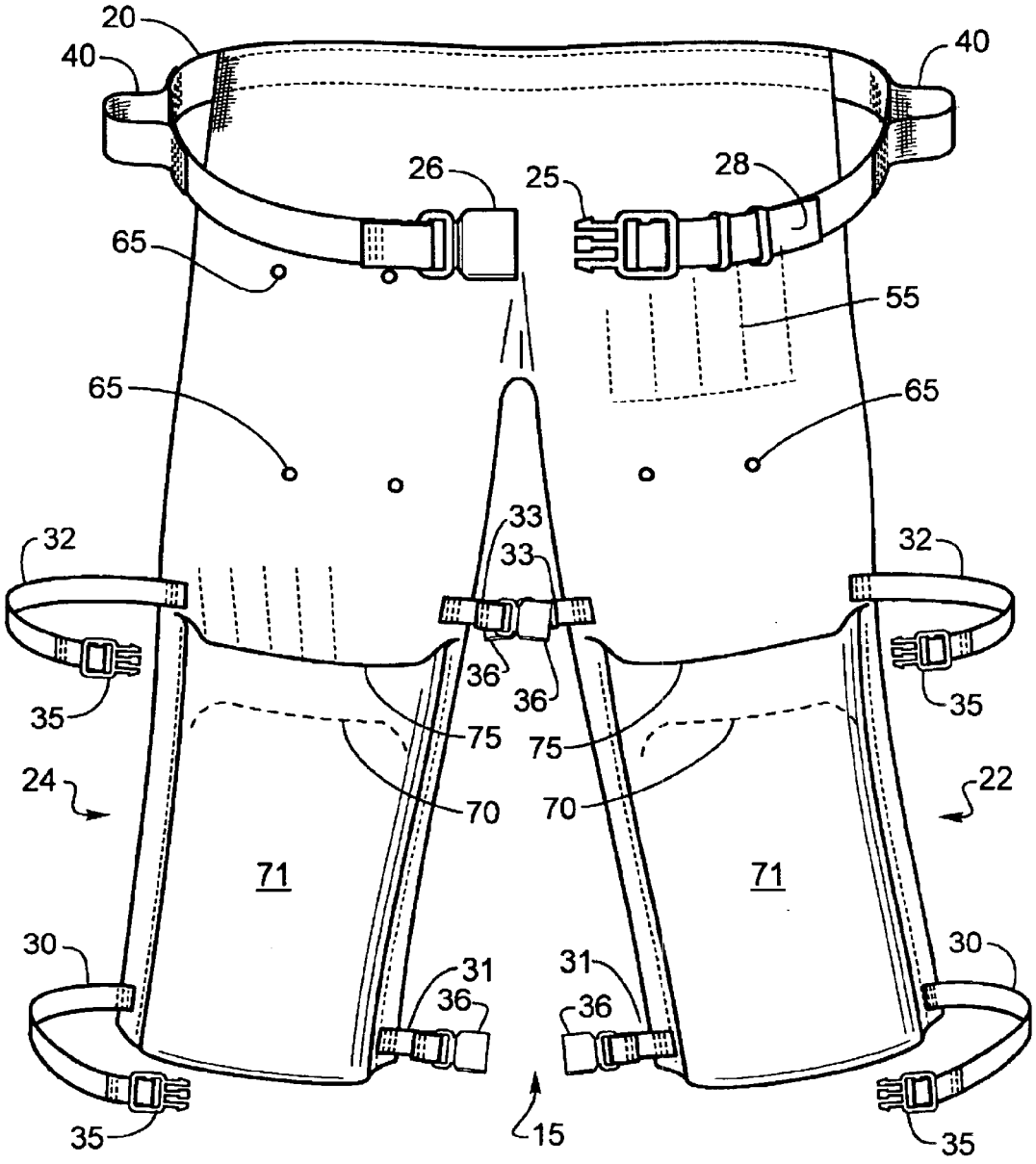
FIG. 2 is a rear view of the work clothing

The front of the work clothing 15 may have permanent pockets 50 for holding articles. The front of the work clothing 15 may also have a more specialized compartmentalized pocket 56, divided into smaller sections for holding pencils, screwdrivers or other tools. As seen in FIG. 2 the pocket compartments 55 have stitching between the pocket segments of compartmentalized pocket 56. Pocket 56 may also have a strip of material 54 sewn across the face of the pocket and having stitching as the pocket 56 has to create loops for hanging tools such as tape measures, chisels, screw drivers and other tools.

The front of the work clothing 15 may also have snap-on pockets 60 having snaps 66 on the pockets attaching to snaps 65 on the legs 22 and 24. The snap-on pockets 60 may vary in depth and width. The snap-on pockets 60 may be segmented or have one cavity. The use of the snap-on pockets 60 will vary as the garment is used for different tasks. A shallow one-cavity pocket may be used for carrying nails for a roofer. A long narrow multi-cavity pocket may be used for carrying screwdrivers. The snap-on pockets 60 are optional. There are uses for the garment in which the snap-on pockets 60 may be in the way and are removed.

The snaps 66 and 65 to fasten the pockets to the pants portion may be replaced with other fasteners such as buttons, clips, pins, or VELCRO® hook and loop fasteners.

The work clothing 15 can have loops 40 attached to the belt 20 or to the pants portion for carrying hammers or other tools.

The work clothing 15 may have straps such as long thigh straps 32 and short thigh straps 33 and long knee straps 30 and short knee straps 31 for fastening the right and left legs 22 and 24 respectively of the work clothing 15 to the wearer's legs. The long straps 30, 32 may have male connection portions 35 and the short straps 31, 33 may have female connection portions 36 such that the long straps 30 and 32 can easily be connected to or removed from the short straps 31 and 33. If male 35 and female 36 connecting portions are not used on the straps the straps may have VELCRO® tabs or some other fastening means such as buckles to attach one strap to the other.

As best seen in FIG. 2 kneepad 70 is inserted into kneepad pocket 75 on the work clothing 15 inside of each of the right and left legs 22 and 24 respectively to provide padding for wearers who will be working on their knees. The kneepads 70 may be replaced easily by removing worn kneepads 70 from the kneepad pockets 75 and replacing them with new kneepads 70. Optionally the kneepads 70 can be removed from the kneepad pockets 75 when not needed or to launder the work clothing 15.

The knee straps 30 and 31 go around the calf of the wearer's leg so that the kneepad 70 is held over the wearer's knee as shown on FIG. 1 in kneepad area 71. The work clothing 15 is like a pair of shorts in that it extends just below the wearer's knees and not all the way to his feet.

The apron-like garment 15 is easy to put on and take off by using the belt 20 and straps 30, 31, 32, and 33. The work clothing 15 is cool since it does not surround the wearer for use on hot summer days when gardening, roofing other outdoor activities take place.

The work clothing 15 material can be denim or other durable material generally used for work clothing.

The belt 20 may be made out of nylon or other durable high strength material.

The knee pads 70 can be made out of a neoprene or other soft but durable material to protect the wearers knees and make working in a kneeling position more comfortable, while protecting the knees from rocks or other uneven perturbances on the ground or other surface. The knee pads also protect the wearer and his regular clothing from moisture and heat transfer from kneeling on hot roofs or cold ground.

Obviously, many modifications and variations of the present invention are possible in light of the above teachings. It is therefore to be understood that, within the scope of the appended claims, the invention may be practiced otherwise than as specifically described.

What is claimed is:

1. A garment comprising:

a belt portion for encompassing the waist of a wearer, a pants panel portion having a right leg portion and a left leg portion attached to the belt portion, for covering a portion of the front of a pair of pants to just below the knees of the wearer, the pants panel portion having attachment means for removably attaching a specialized pocket to the garment for storage of articles, the left leg portion and right leg portion having knee pad pockets, and knee pads for insertion into the knee pad pockets for protecting the knees of the wearer when kneeling, a strap on the right leg portion and a strap on the left leg portion for encircling the right and left legs of the wearer above the knee to keep the garment in place over the wearer's legs, a strap on the right leg portion and a strap on the left leg portion for encircling the right and left legs of the wearer below the knee to keep the garment in place over the wearer's legs.

2. A garment as in claim 1 having, pockets permanently fixed to the garment.

3. A garment as in claim 1 having, loops permanently fixed to the garment.

4. A garment as in claim 2 having, loops permanently fixed to the garment.

5. A garment as in claim 2 having, at least one of the pockets having segments for holding different articles.

6. A garment as in claim 1 having, the attachable pockets are selected from a group of pockets for different uses.

7. A garment as in claim 2 having, pockets permanently fixed to the garment.

8. A garment as in claim 7 having, loops permanently fixed to the garment.

* * * * *